United States Patent [19]

Lööf

[11] 4,199,884

[45] Apr. 29, 1980

[54] MARKING SLEEVE FOR WIRES

[76] Inventor: Nils O. T. Lööf, Gullspång, Sweden

[21] Appl. No.: 858,591

[22] Filed: Dec. 8, 1977

Related U.S. Application Data

[63] Continuation of Ser. No. 710,933, Aug. 2, 1976, abandoned.

[30] Foreign Application Priority Data

Aug. 13, 1975 [SE] Sweden ..... 7509060

[51] Int. Cl.[2] ..... G09F 3/04

[52] U.S. Cl. ..... 40/316

[58] Field of Search ..... 40/316, 359, 19, 21 R; 138/178, 104, 118, 119, 121

[56] References Cited

U.S. PATENT DOCUMENTS

| | | | |
|---|---|---|---|
| 2,514,437 | 7/1950 | Bailhe | 40/316 X |
| 3,487,574 | 1/1970 | Loof | 40/316 |
| 3,491,472 | 1/1970 | Walldorf | 40/316 |

*Primary Examiner*—Frederick R. Schmidt

*Attorney, Agent, or Firm*—Pollock, Vande Sande & Priddy

[57] ABSTRACT

A marking device for thin wires, conductors and the like comprises two major portions. The first portion is of substantially arcuate cross-section and its inner wall extends along at least half the circumference of the thinnest wire on which the device may be mounted. The second portion, which is integral with the first one, consists of two flange-like projections extending radially outwards and interconnected at their outer ends. Their outer walls offer large areas for receiving symbols. When the device is mounted on a maximum diameter wire the arcuate portion and the projections are stretched to form a circular sleeve the inner wall of which contacts the wire along all of its circumference.

2 Claims, 4 Drawing Figures

MARKING SLEEVE FOR WIRES

This is a continuation of application Ser. No. 710,933, filed Aug. 2, 1976 now abandoned.

The present invention relates to a novel marking device for wires. More specifically, the invention relates to a marking device in the shape of a tubular body made of an elastic material, such as a synthetic plastic, and designed so as to be especially adapted for use on thin wires, conductors and the like. The tubular body is intended to be passed over the wire and the marking symbols are on the outer wall of the body, normally embossed therein.

My U.S. Pat. No. 3,534,777 discloses a marking device of the general type above described. It consists of an expansible sleeve having a generally flat, outer top portion carrying the marking symbols and a bellows-like bottom portion which makes the sleeve expansible. As stated in the specification of the just-mentioned patent such a sleeve may be fitted to wires or the like in the diameter interval from 23 mils (0.6 mm) to ⅝ inches (approximately 16 mm). This wide field of use is mainly the result of the bellows-like portion which at different degrees of expansion gives the marking sleeve correspondingly different effective inner diameters. It is, however, also a consequence of the expansible portion featuring flanges or the like extending inwardly for the purpose of giving lateral support to thin wires.

During the last decade the use of marking sleeves in different industries has increased heavily. In addition thereto, as is well-known, the trend is towards compact and miniaturized circuits or components. Both those factores have created a need for marking devices which can be used on very thin wires. The obvious solution to the corresponding problem was to scale down the absolute dimensions of prior art marking devices, basically of the type disclosed in my U.S. patent above referred to. It was, however, soon established that this is a far from satisfactory solution. The reduction of the marking sleeve itself did by necessity also proportionally reduce the size of the marking symbols. For that reason one did rather soon pass the limit below which reading of the symbols required the used of a magnifying glass. Such a procedure is naturally not practical and in terms of wire identification possibilities the development towards more compact units therefore represented a step backwards.

Still another special difficulty in using prior art marking sleeves on very thin wires stems from the following factual circumstances. As is known, it is for several reasons usual to arrange a plurality of such thin wires parallel and close to each other so that a wire bundle is formed. If each individual wire in such a bundle carries a marking sleeve of the general type above discussed, i.e. e.g. according to U.S. Pat. No. 3,534,777, it will surround a wire the diameter of which is at the bottom end of the usable diameter interval. Stated in other words, the cross-sectional area of the wire occupies just a very small portion of the cross-sectional area of the marking sleeve which makes the marking device that bulky in relation to the cross-sectional dimension of the wire that it becomes completely impossible to mount such a marking sleeve on each wire of the bundle.

The object of the invention is to provide a marking device which renders itself for use on thin wires and does not suffer from the disadvantages and shortcomings above discussed.

Briefly, in accordance with the present invention, a marking device for thin wires, conductors and the like is provided which consists of a tubular body extruded from an elastic material. It is intended to be threaded on the wire or the like and, thanks to the elasticity of the material, it can within limits be used on wires having different diameters. The marking symbols are on the outer wall of the tubular body. Marking devices answering that general description are previously known. According to the main characteristic of the invention, when the marking device is not mounted on a wire, it comprises a first portion and a second portion integral with the first portion. Said first portion is of substantially arcuate cross-section and its inner wall corresponds to at least half the circumference of the thinnest wire on which the device can be used. At its both ends the arc is connected to the second portion of the tubular body which portion is in the form of two flanges substantially radially located and interconnected at their ends remote from the first portion. The outer walls of those flanges form surfaces for receiving the marking symbols.

The location of the marking symbols on radially extending flanges instead of on the outside of a top portion according to the prior art results in several important advantages. The surface available for the marking symbols is no longer restricted by the diameter of the wire but may be arbitrarly large. It equals the product of the lenght of the tubular body in the axial direction of the wire and the radial extension of the flanges. As is understood, both those dimensions can be increased without affecting the arcuate first portion of the device. This applies when the device is threaded on a wire the diameter of which falls within the bottom portion of the corresponding interval. When the device is used on a wire of maximum diameter and thus is completely extended, its portion carrying the marking symbols will naturally no longer be radially oriented. Instead, it will, together with the first portion of the tubular body, form an annular sleeve surrounding the wire and contacting it in each point along its circumference. As will be explained below, a further advantage is that the surface available for receiving marking symbols is doubled, namely if such symbols are present on the outer wall of each of the two radially extending flanges.

One embodiment of the invention will now be described in greater detail, reference being made to the drawing, in which.

Figure 1:
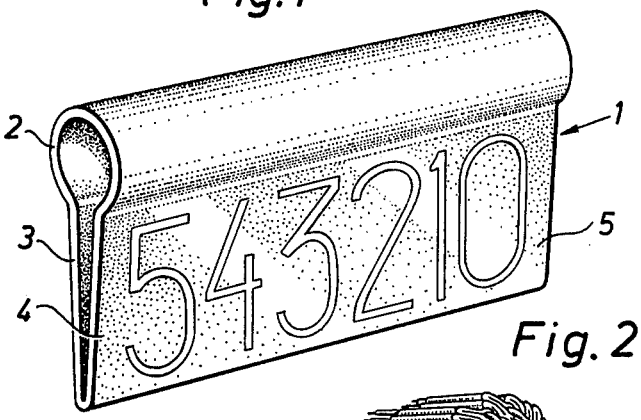
FIG. 1 shows on an enlarged scale a perspective view of a marking device according to the invention.

The marking sleeve 1 shown on the drawing comprises a first portion 2 of substantially arcuate cross-section and a second portion consisting of two flanges 3 and 4. The length of the arc formed by portion 2 should correspond to at least half the circumference of the thinnest wire for which the device can be used. As appears from the drawing, according to the illustrated embodiment the wire-receiving portion 2 actually encloses an angle substantially greater than 180°. As a matter of fact, portion 2 almost forms a complete circle.

At the ends of the arc portion 2 is integral with flanges 3 and 4 which are practically parallel to each other and have flat inner and outer walls. The marking symbols 5 are located on the outer wall of the one or both flanges.

Figure 2:
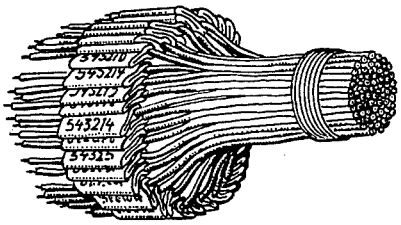
FIG. 2 is a perspective view, substantially on a natural scale, showing a wire bundle the individual wires of which carry marking devices according to the invention.

FIG. 2 shows a bundle of wires each of which carries a marking sleeve according to FIG. 1. The sleeves have been mounted on the wires where the bundle has been radially expanded, e.g. for connection to a multi-pole plug.

Figure 3:
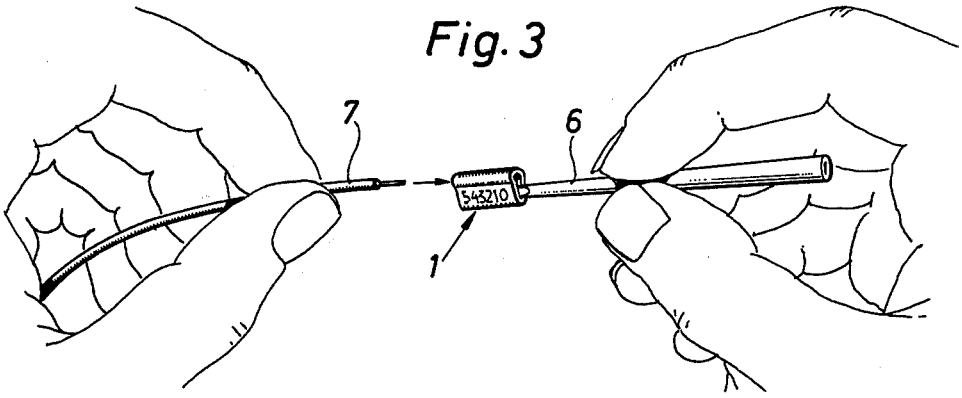
FIGS. 3 and 4 illustrate one way of mounting the device on a thin wire.
Figure 4:
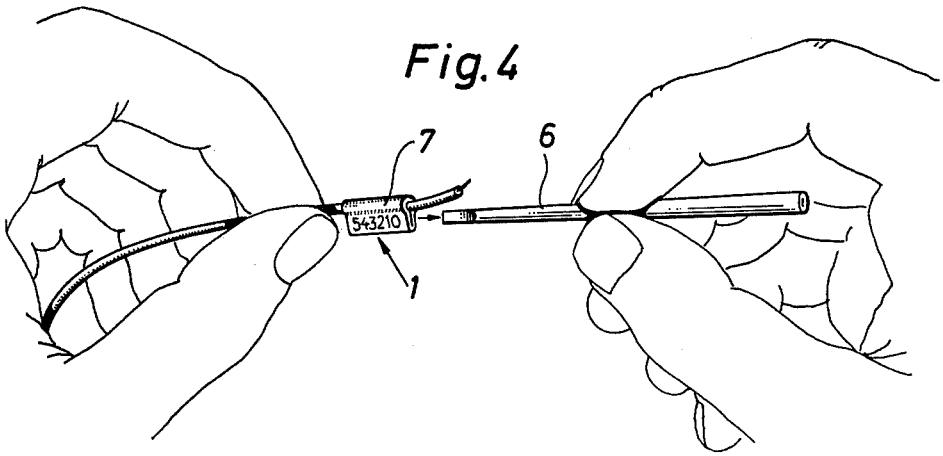

FIGS. 3 and 4 illustrate the use of a special tool, a chisel-like probe 6 facilitating the mounting of a marking sleeve 1 onto a thin wire 7. The first step, shown in FIG. 3, consists in a introducing tool 6 between the two flat flanges 3 and 4, whereby the arcuate portion 2 is expanded so that it can easily receive wire 7. Thereafter tool 6 is again extracted as shown in FIG. 4.

The invention has for the first time made it practical to provide thin wires with marking devices. As was mentioned in the introduction to this specification, before the present invention was made the tendency was to refrain from such markings. The result was that when a fault appeared in an installation comprising a multiplicity of such thin wires it was as a rule impossible quickly to identify a certain individual wire. This often made it necessary to remove and replace all wires. The possibility afforded by the invention in a satisfactory manner to provide also very thin wires with conveniently readable markings can be apprehended as the overcoming of a prejudice, namely that the marking symbols must directly or indirectly be carried by a tubular sleeve or ring surrounding the wire. It should be observed that when a marking device according to the invention is mounted on a wire the diameter of which falls at the lower end of the useful diameter range, flanges 3 and 4 will extend substantially radially outwards from the wire. This makes it possible to have them located outside the bundle which means not only that the increase of the effective cross-section of the bundle is reduced but also that the reading of the marking symbols is facilitated.

It was mentioned above that marking symbols can be applied to the outer wall of either or both of the substantially flat flanges 3 and 4. In the latter case the marking text can either be identical on both sides or divided into two halves. One way of making such a division is on the one side to apply symbols in the form of letters identifying a certain group of wires or the like, whereas the individual wires within each group are identified by symbols in the form of figures on the opposite flange.

It should be emphasized that the drawing is intended to illustrate the inventive idea only and not to limit the scope of the invention to the sizes and proportions shown. For example, the arcuate portion 2 can be given thicker walls than flanges 3 and 4, whereby the retention of the sleeve on very thin wires is improved.

What I claim is:

1. A marker suitable for application on thin electrical wires and the like, said marker consisting of a deformable tubular body extruded from a flexible plastic material and closed in a circumferential direction, and comprising in an undeformed condition, a first portion of substantially arcuate cross-section with a circular inner wall extending through an angle substantially greater than 180° so that the inner wall corresponds to substantially more than ½ the circumference of a thinnest wire in a range of thicknesses to which said marker is applicable and a second portion which is integral with the first portion and comprises two flange-like projections extending approximately radially outwardly from the first portion and interconnected at their outer ends, at least one of said projections carrying visible indicia, said marker being capable of application on wires having a range of thicknesses, said first portion having said inner wall extending along at least half the circumference of the thinnest wire in said range, so that when the marker is mounted on such a wire, said two flange-like projections are substantially parallel and said inner wall serves to retain said marker on said wire, and in a deformed condition, said arcuate portion and said flange-like projections being deformed so as to together form a sleeve of circular cross-section surrounding the thickest wire in said range.

2. The marker of claim 1 in which both said two flange-like projections carry visible indicia.

* * * * *